US006419180B1

(12) United States Patent
Gmeiner

(10) Patent No.: US 6,419,180 B1
(45) Date of Patent: Jul. 16, 2002

(54) CABLE GUIDANCE APPARATUS

(75) Inventor: Paul Gmeiner, Oberwil-Lieli (CH)

(73) Assignee: Micafil AG, Zurich (CH)

( * ) Notice: Subject to any disclaimer, the term of this patent is extended or adjusted under 35 U.S.C. 154(b) by 0 days.

(21) Appl. No.: 09/615,951

(22) Filed: Jul. 13, 2000

(30) Foreign Application Priority Data

Jul. 14, 1999 (DE) ..... 199 32 756

(51) Int. Cl.[7] ..... B65H 23/06
(52) U.S. Cl. ..... 242/420.6
(58) Field of Search ..... 242/420, 420.3, 242/420.6

(56) References Cited

U.S. PATENT DOCUMENTS 2,816,758 A * 12/1957 Danly ..... 242/420.6
5,890,672 A * 4/1999 Alexander, III et al. . 242/420.6

FOREIGN PATENT DOCUMENTS

DE 1235571 10/1967
DE 59302 12/1967

OTHER PUBLICATIONS

"Zugkraft–Regelungssysteme fur die LWL–Verseilung", Meerkamm, et al., DRAHTWELT, Oct. 1987, pp. 169–173.

* cited by examiner

*Primary Examiner*—John Q. Nguyen
(74) *Attorney, Agent, or Firm*—Burns, Doane, Swecker & Mathis, L.L.P.

(57) ABSTRACT

The apparatus is intended for guiding a cable from an outlet of a cable drum, which is rotated by a drive, to an inlet of a cable processing appliance which draws the cable in with a predetermined speed and a tensile force. Between the cable outlet and a cable inlet of the cable processing appliance, the apparatus has an element for guiding the cable, forming at least one rising cable section and at least one falling cable section. The rising cable section is monitored by a first sensor system, and/or the falling cable section is monitored by a second sensor system in each case in order to detect the position of the cable and/or a force acting on the cable. The variables detected by the sensor system are used to control the drive.

11 Claims, 2 Drawing Sheets

Figure 1:
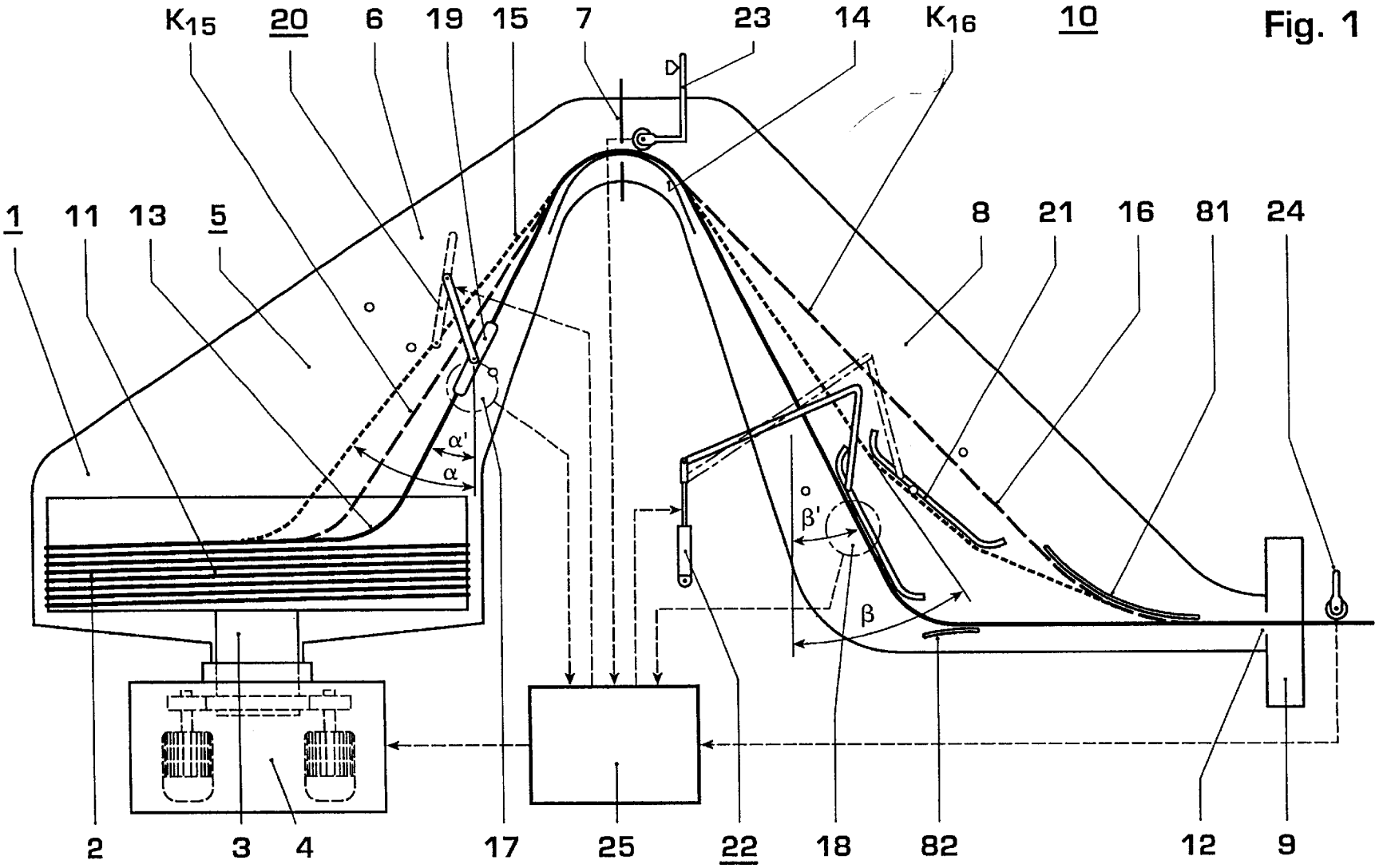

10
24
81
16
21
8
K16
14
23
7
15
19
6
20
K15
5
13
11
1
9
12
82
18
22
25
17
4
3
2
β
β'
α'
α

CABLE GUIDANCE APPARATUS

FIELD OF THE INVENTION

The invention relates to an apparatus for guidance of a cable, as claimed in the preamble of patent claim 1.

BACKGROUND OF THE INVENTION

An apparatus of the abovementioned type is generally used for guiding an unshielded cable between a cable outlet from a drum, which is mounted in an autoclave such that it can rotate, and an inlet of a cable processing appliance, which is arranged outside the autoclave and is generally in the form of a continuously processing press in which the cable is provided with a sheath. Before this, insulation on the cable is dried in the autoclave and it is impregnated with a liquid impregnation agent, in particular insulating oil. A sheath quality which satisfies the desired requirements is achieved if the cable is drawn into the press with a predetermined speed and with a predetermined tensile force. These predetermined parameters are generally maintained by monitoring the speed of the cable between the cable outlet and the cable inlet, and by means of a control and regulation apparatus which compares the cable speed with nominal values and accelerates or brakes a cable drum drive if the values being compared with one another differ.

SUMMARY OF THE INVENTION

The invention, as it is defined in the patent claims, is based on the object of specifying a cable guidance apparatus of the type mentioned initially, which always ensures that the predetermined parameters are maintained with high reliability.

In the cable guidance apparatus according to the invention, the unsheathed cable is guided to form a falling cable section and a rising cable section. The position of the cable and/or a force acting on the cable can be monitored in each section, by a sensor system. If an excessive position or force error is found during this monitoring process, then the drum drive can be actuated appropriately to compensate for this error, and undesirably large fluctuations in the speed and the tensile force acting while the cable is being drawn into the cable processing appliance can in this way be avoided irrespective of the diameter of the cable or of the appliance's cable outlet. The cable drum can thus be arranged with a horizontal or vertical axis, or with an axis aligned between the horizontal and vertical.

Since, two cable sections which are spatially separated and are subjected to different conditions can be monitored independently of one another, the cable guidance apparatus according to the invention is distinguished by particularly high operational reliability. A sheathing process provided in a downstream cable processing appliance can thus be carried out with high precision.

If at least one of the two sections of the cable which are spatially separated from one another has an additional force applied to it which, in a section facing away from the drum, can be a supporting force which is small in comparison with the predetermined and tensile force or, in a section facing the cable processing appliance, can be a prestressing force which is larger in comparison, then the force acting at the two locally separate points on the cable can be detected particularly easily and can be used in a particularly advantageous manner to control the drum drive.

Figure 2:
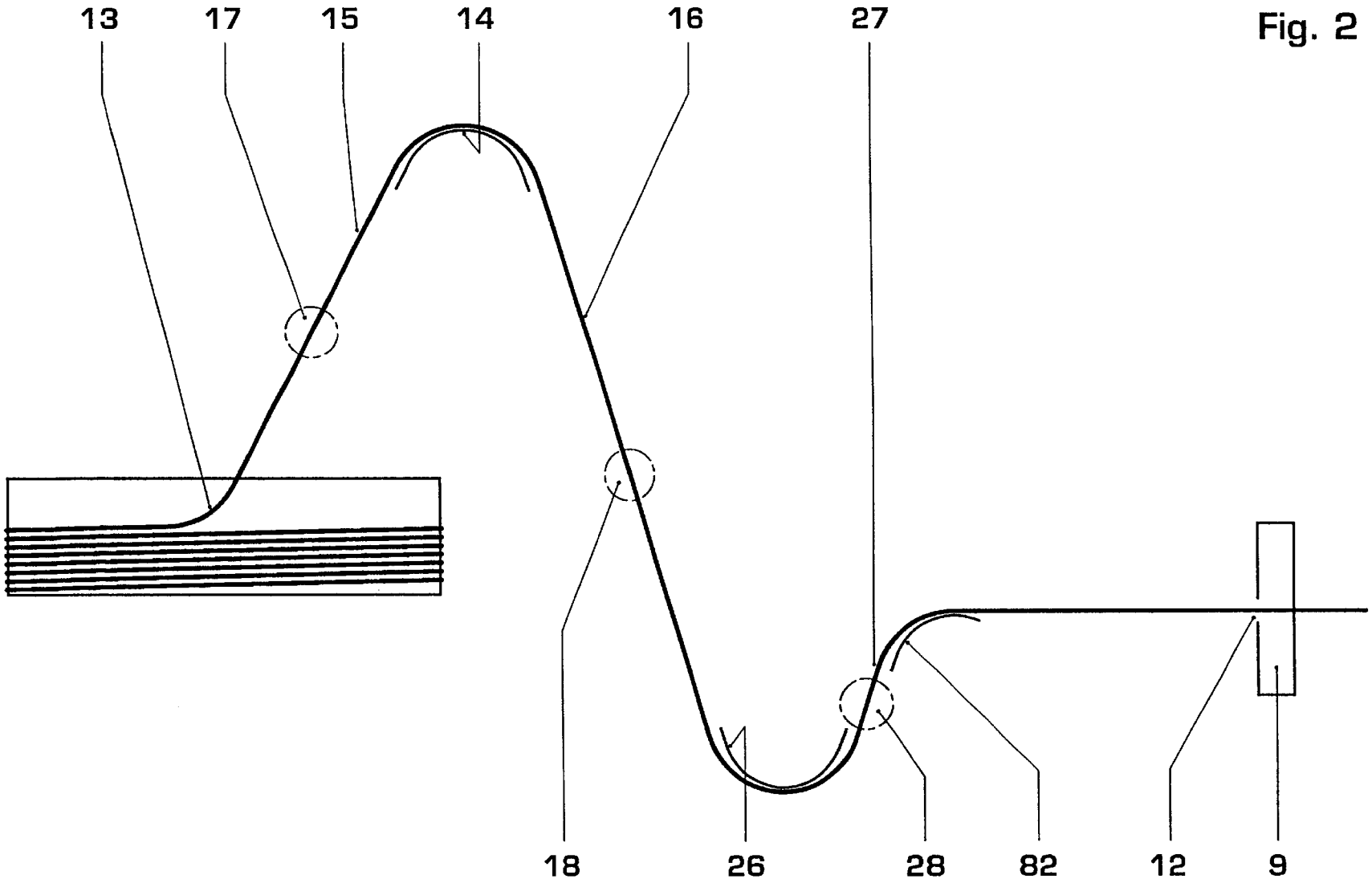

BRIEF DESCRIPTION OF THE DRAWINGS (A) Preferred embodiment/s of the invention is/are disclosed in the following description and illustrated in the accompanying drawings, in which:

FIG. 1 shows a side view of a part, which is illustrated predominantly in outline form, of a cable processing system having an autoclave which holds a cable drum, and having a first embodiment of the cable guidance apparatus according to the invention, in which parts of the autoclave and guide housings facing the viewer have been removed, and FIG. 2 shows a side view of a part, which is illustrated in outline form, of a cable processing system having a second embodiment of the cable guidance apparatus according to the invention, in which the guide housing has been removed.

DETAILED DESCRIPTION OF THE INVENTION

In both figures, the same reference symbols relate to parts having the same effect. The part of the cable processing system shown in FIG. 1 contains an autoclave 1 which holds a cable drum 2 which can rotate about a vertical axis. A shaft 3 which causes the cable drum 2 to rotate is connected via a vacuum-resistant bushing to an electrical drive 4 arranged outside the autoclave 1. The autoclave has a pressure-tight and vacuum-tight housing 5 with a housing attachment 6 which points obliquely upward and tapers in the form of a nozzle. The housing attachment 6 ends in a vertically guided flange. This flange is part of a flange connection 7. The opposing flange of the flange connection 7 is part of a guide housing 8, which essentially corresponds to the housing attachment 6 but is arranged with mirror-image symmetry with respect to the flange connection 7. At its right-hand end, the guide housing 8 ends in a flange which is part of a flange connection of the guide housing 8 with a cable processing appliance 9.

The housing attachment 6 and the housing 8 are part of a cable guidance apparatus 10. The cable guidance apparatus 10 allows an unshielded cable 11 which is intended, for example, for carrying high voltage and typically has a diameter of 5 to 10 cm to be unwound uniformly from the cable drum 2, and ensures that the cable 11 is guided to a cable inlet 12 of the cable processing appliance 9 with a predetermined speed and predetermined tensile force. The unsheathed cable 11 is provided with a sheath in the appliance 9. For this operation, it is desirable for the unsheathed cable to be guided to the inlet 12 of the cable processing appliance 9 with a predetermined speed and predetermined tensile force.

In order to achieve this cable guidance, the cable guidance apparatus 10 has, between an outlet 13 of the cable 11 from the drum 2 and the cable inlet 12, a guide element, which is arranged higher than the cable outlet 13 and the cable inlet 12 and is in the form of a saddle 14, for attachment of the cable 11. In this case, a cable section 15 which rises in the form of a catenary line $K_{15}$ (shown by a dotted line) is formed between the cable outlet 13 and the saddle 14, and a cable section 16 which falls in the form of a catenary line $K_{16}$ (likewise shown by a dotted line) is formed between the saddle 14 and the cable inlet 12. The catenary lines indicate the position of the cable in the cable sections 15 and 16 when the cable is loaded with the speed and tensile force predetermined by the cable processing appliance 9. The catenary line $K_{16}$ has a flatter shape than the catenary line $K_{15}$ since, owing to the friction that has to be overcome in the saddle 14, the cable is subjected to a considerably greater tensile force in the cable section 16 than in the cable section 15.

The position of the cable 11 and/or the force acting on the cable 11 are/is detected by means of two sensor systems 17, 18 (which are each illustrated schematically as a circle), of which the sensor system 17 monitors the cable section 15, and the sensor system 18 monitors the cable section 16. The sensor systems 17 and 18 preferably detect the direction and/or the position coordinates of the cable 11, and have an incremental sensor and/or a position sensor for this purpose.

The rising cable section 15 preferably has a small supporting force applied in its central region. The cable is then guided upward from its position defined by the catenary line $K_{15}$ and then assumes the position shown by the dashed line in the figure. Depending on the tensile stress that acts, the cable can then fluctuate within a defined range about this position. The supporting force is produced by a hollow arm 19, which guides the cable, of a supporting apparatus 20 which can preferably be operated hydraulically or pneumatically, and is detected by a force sensor contained in the sensor system 17.

The falling cable section 16 preferably has a prestressing force, which is larger than the supporting force, applied in its central region. The cable is then guided away downward from the catenary line $K_{16}$ and is located in the position shown by the dashed line in the figure. Depending on the tensile stress that acts, the cable can then fluctuate within a defined range about this position. The prestressing force is produced by an arm 21, which is pressed against the cable, of a positioning apparatus 22 which can preferably be operated hydraulically or pneumatically, and is detected by a force sensor contained in the sensor system 18.

Reliable guidance of the falling cable section 16 of the cable 11 close to the flange 80 is achieved by a guide plate 81 or 82, respectively, which is arranged above or below the cable, respectively, and is in each case bent away from the cable.

A sensor 23 which detects the speed of the cable 11 on leaving the housing attachment 6 is arranged in the region of the saddle 14, and a further sensor 24, which detects the cable speed, is arranged after the cable inlet 12. The data detected by the sensors 17, 18, 23 and 24 are passed to a control and regulation apparatus 25 and, after comparison with stored nominal values, output signals are if necessary formed with which the drive 4 and/or at least one of the two positioning apparatuses 20 and 22 can be actuated.

The guidance apparatus operates as follows: After a process step which is carried out in the autoclave 1, during which the unsheathed cable 11 is dried and is impregnated with a liquid impregnation agent such as insulating oil, the cable 11 is drawn, for example using a secondary cable, consecutively through the arm 19, over the saddle 14 and through the arm 21 to the inlet 12 of the cable processing appliance 9, and has a tensile force applied to it which is predetermined during normal operation of the cable processing appliance. The arms 19 and 21 are positioned with the positioning apparatuses such that they rest on the cable virtually without applying any force. The cable sections 15 and 16 then respectively have the form of catenary lines $K_{15}$ and $K_{16}$. The positioning appliance 20 applies a small supporting force to the cable section 15 of the cable, and guides it to the position shown by a dashed line in the figure. In this position, the arm 19 has defined position coordinates and is inclined to the vertical in a plane at right angles to the plane of the drawing, through an angle $\alpha$ to the vertical and through an angle $\gamma$, which cannot be seen in the figure, which is dependent on the position of the cable outlet 13. The positioning appliance 22 applies the prestressing force, which is larger than the supporting force, to the cable section 16 of the cable, and guides it to the position shown by a dashed line in the figure. In this position, the upper end of the arm 21 has defined position coordinates, and that part of the cable which is located between the upper end of the arm 21 and the saddle 14 forms an angle $\beta$ with the vertical in the plane of the drawing. The angles $\alpha$ and $\beta$ as well as the supporting force and the prestressing force are stored as nominal values in the control and regulation apparatus 25.

By operating the drive (which is not shown) of the cable processing appliance 9 and the drive 4, the cable 11 is now drawn through the cable processing appliance 9 at the predetermined speed and maintaining the predetermined tensile force, and is sheathed. For high-quality cable, it is of major importance for the tensile force and the speed at which the cable is drawn in to fluctuate only within narrow tolerances. The speed of the cable 11 emerging from the cable guidance apparatus 10 is thus detected by the speed sensor 24, which is preferably in the form of an incremental transmitter. The speed of the cable emerging from the housing attachment 6 is also detected, in a corresponding manner, by the speed sensor 23. The speed values detected by the two sensors 23 and 24 are compared with one another in the control and regulation apparatus 25. If the error is excessively large, a control signal is produced and equilibrium between the speed values is achieved once more by accelerating or braking the cable drum 2 by means of the drive 4. This control system, which is based on a speed measurement, has a control system superimposed on it based on monitoring of the position and/or force on the arm 19 and on the arm 21. Specifically, if the control and regulation apparatus 25 finds that the parameters which are determined continuously by the sensor systems 17 and 18, respectively, such as the position coordinates of the arms 19 and 21, respectively, and/or the angles $\alpha$ and $\beta$, respectively, and/or the forces, such as the supporting force or the prestressing force, respectively, differ by an unacceptably large amount from the nominal value, then it controls the drive 4 in such a manner that this error is corrected.

If, for example, the cable and the positioning apparatus 20 are in the position shown by solid lines in the figure, then the sensor system 17 identifies an angle $\alpha'$, which is smaller than the angle $\alpha$, and/or a supporting force which is less than the stored supporting force. If this angle or the supporting force differs excessively from the nominal angle $\alpha$ or the (stored) nominal supporting force, then the control and regulation apparatus 25 brakes the drive 4 until this error is within a permissible fluctuation range. If, on the other hand, the control and regulation apparatus 25 finds an excessively large angle or an excessively large supporting force, then the drive 4 is accelerated until the determined error is within the permissible fluctuation range.

If the cable and the positioning apparatus 22 are in the position shown by solid lines in the figure, then the sensor system 18 identifies an angle $\beta'$ which is smaller than the angle $\beta$ and/or a prestressing force which is smaller than the stored prestressing force. If this angle or the prestressing force differs excessively from the nominal angle $\beta$ or the (stored) nominal prestressing force, then the control and regulation apparatus 25 brakes the drive 4 until this error is within a permissible fluctuation range. If, on the other hand, the control and regulation apparatus 25 finds an excessively large angle or an excessively large prestressing force, then the drive 4 is accelerated until the determined error is within the permissible fluctuation range.

In the embodiment of the guidance apparatus shown in FIG. 2, the unsheathed cable is also guided over an element 26, in contrast to the embodiment shown in FIG. 1. The guide element 26 is arranged offset downward with respect to the guide element 14 and the cable outlet 13 and the cable inlet 12. A cable section 27, which rises between the guide element 26 and the cable inlet 12 is thus also formed in addition to the cable section 15 which rises between the cable inlet 12 and the guide element 14, and the cable section 16 which falls between the two guide elements 14 and 26. The cable section 27 is monitored by a sensor system 28 which, like the sensor systems 17 and 18, detect the position of the cable and/or a force acting on the cable, and act on the control and regulation apparatus 25, which is not shown in FIG. 2. This additional monitoring of the cable further increases the operational reliability of the guidance apparatus 10. However, in general, it is completely sufficient for reliable operation of the apparatus for at least one of the three cable sections 15, 16, 27 to be monitored by one of the sensor systems 17, 18, 28.

What is claimed is:

1. An apparatus for guiding a cable from an outlet of a cable drum, which is rotated by a drive, to an inlet of a cable processing appliance, which draws the cable in with a predetermined speed and tensile force, comprising (a) a control and regulation apparatus acting on the drive, (b) an element for guiding the cable which is arranged higher than the cable outlet and the cable inlet, which is in the form of a saddle, which forms a rising cable section rising between the cable outlet and the saddle in the form of a first catenary line, and which forms a falling cable section falling between the saddle and the cable inlet in the form of second catenary line, (c) a first sensor system for monitoring the position of the cable and/or the force acting on the cable in the falling cable section and for passing detected values of the position and/or force to the control and regulation apparatus, and (d) means for generating in a central region of the falling cable section a prestressing force in such a manner that the cable is guided away downward from the catenary line, (e) in which said prestress force generating means comprise a preferably hydraulically or pneumatically operated positioning device with an arm which for reason of generating the prestressing force is pressed against the cable.

2. The apparatus as claimed in claim 1, further comprising at least a second sensor system for monitoring the position of the cable and/or force acting on the cable in the rising cable section and for passing the detected values to the control and regulation apparatus.

3. The apparatus as claimed in claim 2, wherein two guide elements are provided, the first of which is higher than the cable outlet and the cable inlet and the second of which is arranged offset downward with respect to the first guide element, the cable outlet and the cable inlet, in such a manner that a rising first cable section is arranged between the cable inlet and the first guide element, a falling cable section is arranged between the first guide element and the second guide element, and a rising second cable section is arranged between the second guide element and the cable inlet, and wherein at least one of the three cable sections is monitored by one of the sensor systems.

4. The apparatus as claimed in claim 2, wherein the at least one first sensor system and/or the second sensor system in each case detect/detects the location coordinates and/or the direction of the cable.

5. The apparatus as claimed in claim 4, wherein the at least one first sensor system and/or the second sensor system each contain/contains a position transmitter and/or an incremental transmitter.

6. The apparatus as claimed in claim 2, wherein a third sensor system is also provided, having a sensor which detects the speed of the cable.

7. The apparatus as claimed in claim 6, wherein the speed is detected in the region of the saddle.

8. The apparatus as claimed in claim 2, wherein the second sensor system has a force transmitter which detects the prestressing force in the cable.

9. The apparatus as claimed in claim 1, wherein the rising cable section has a supporting force, which is less than the prestressing force, applied in a central region of the rising cable section, in such a manner that the cable is guided upward from the rising catenary line which is defined by a predetermined small tensile force.

10. The apparatus as claimed in claim 9, wherein the supporting force can be produced by a hollow arm, which guides the cable, of a supporting apparatus which is operated hydraulically or pneumatically.

11. The apparatus as claimed in claim 10, wherein the first sensor system has a force transmitter which detects the supporting force.

* * * * *